US007479856B2

(12) United States Patent
Asamura et al.

(10) Patent No.: US 7,479,856 B2
(45) Date of Patent: Jan. 20, 2009

(54) HIGH-FREQUENCY FILTER USING COPLANAR LINE RESONATOR

(75) Inventors: Fumio Asamura, Saitama (JP); Kenji Kawahata, Saitama (JP); Katsuaki Sakamoto, Saitama (JP)

(73) Assignee: Nihon Dempa Kogyo Co., Ltd., Tokyo (JP)

( * ) Notice: Subject to any disclaimer, the term of this patent is extended or adjusted under 35 U.S.C. 154(b) by 310 days.

(21) Appl. No.: 11/362,241

(22) Filed: Feb. 24, 2006

(65) Prior Publication Data

US 2006/0192639 A1 Aug. 31, 2006

(30) Foreign Application Priority Data

Feb. 25, 2005 (JP) ..... 2005-051840

(51) Int. Cl.
*H01P 1/203* (2006.01)

(52) U.S. Cl. ..... 333/204; 333/205

(58) Field of Classification Search ..... 333/204, 333/205, 219, 235
See application file for complete search history.

(56) References Cited

U.S. PATENT DOCUMENTS 5,136,269 A * 8/1992 Seitzer et al. ..... 333/204
6,798,319 B2 9/2004 Aikawa et al.
7,061,333 B2 * 6/2006 Aikawa et al. ..... 331/56
7,113,059 B2 * 9/2006 Asamura ..... 333/205
2003/0102942 A1 * 6/2003 Aikawa et al. ..... 333/204
2003/0122628 A1 * 7/2003 Aikawa et al. ..... 331/107 G
2005/0162241 A1 7/2005 Asamura

* cited by examiner

*Primary Examiner*—Seungsook Ham
(74) *Attorney, Agent, or Firm*—Knobbe Martens Olson & Bear LLP

(57) ABSTRACT

A high-frequency filter includes a substrate; a ground conductor disposed on one main surface of the substrate and having an opening; a center conductor making up a coplanar line resonator together with the substrate and the ground conductor; and an input line and an output line each of which has a microstrip line structure and is disposed on the other main surface of the substrate to electromagnetically couple with the center conductor. At least one of the input line and the output line has a closed loop line portion surrounding a corresponding end of the center conductor and crossing the center conductor transversely through the substrate. On the other main surface of the substrate, a stub overlapping with the center conductor is arranged from a transverse position where the closed loop line portion crosses the center conductor.

9 Claims, 11 Drawing Sheets

HIGH-FREQUENCY FILTER USING COPLANAR LINE RESONATOR

BACKGROUND OF THE INVENTION

1. Field of the Invention

The present invention relates to a high-frequency filter using a resonator having a transmission line in the form of a coplanar line, and more particularly to a high-frequency filter in which an attenuation pole is provided in transmission characteristics of the filter.

2. Description of the Related Art

A high-frequency filter used in a significantly high frequency band (generally, 1 to 100 GHz) such as of microwave bands and millimeter wave bands is widely used as a functional device indispensable for transmission/reception apparatuses in various radio communication facilities, fiber-optic high-speed transmission apparatuses, and measuring instrument related to the above apparatuses. In recent years, high-frequency filters having a microwave integrated circuit structure have been also used as high-frequency filters used in the significantly high frequency band for with ease in promoting the scale down. For example, in U.S. Pat. No. 6,798,319, disclosed is a high-frequency filter using a resonator having a transmission line in the form of a coplanar line. The transmission line in the form of the coplanar line is a transmission line of a coplanar structure made from a metal conductor in which a high-frequency transmission line is disposed on one main surface of the substrate. The resonator having the transmission line in the form of the coplanar line is called a coplanar line resonator.

FIG. 1A is a plan view showing an example of a conventional high-frequency filter using a coplanar line resonator. FIG. 1B is a cross-sectional view taken along line B-B in FIG. 1A.

Ground conductor 2 is disposed on one main surface of substrate 1 made of a dielectric material. Rectangular opening 3 is formed in ground conductor 2. In opening 3, center conductor 4, which functions as signal line disposed on the one main surface of substrate 1, is provided so as to extend in the longitudinal direction of opening 3. A coplanar line resonator is configure by ground conductor 2 disposed on one main surface of substrate 1 and center conductor (i.e., signal line) 4 inside opening 3 formed in ground conductor 2.

Center conductor 4 is provided with an electric length depending on a dielectric constant of substrate 1 in accordance with a desired resonance frequency (center frequency f0) of the filter. Usually, when a wavelength corresponding to center frequency f0 is λ, the electric length of center conductor 4 is set to λ/2. In other words, the electric length of the coplanar line resonator is set to λ/2 relative to center frequency f0. Both ends of center conductor 4 are spaced apart from ground conductor 2 at both ends (the right and left ends as shown) of opening 3, thereby forming electrically open ends. This arrangement allows generation of a standing wave having a null point of the voltage displacement at a midpoint bisecting center conductor 4 in the longitudinal direction and maximum voltage displacements of mutually reverse polarities at both ends, as indicated by curve S in FIG. 1B, acting as a resonator. The coplanar line is an unbalanced transmission line in which a high-frequency wave travels caused by electric field E generated between center conductor 4 and ground conductor 2 and by magnetic field induced by the electric field. In FIG. 1A, electric field E is indicated by arrows.

Input line 5*a* and output line 5*b* are mounted on the a other main surface of substrate 1 at positions respectively corresponding to the ends of center conductor 4. Input line 5*a* and output line 5*b* are input/output signal lines made of microstrip lines which are electromagnetically coupled with one end and the other end of the coplanar line resonator, respectively. Input line 5*a* is arranged as a linear transmission line extending from a left end (as shown) and is overlapped with one end side (i.e., input side) of center conductor 4 through substrate 1 so as to be electromagnetically coupled. On the other hand, output line 5*b* includes a closed loop line portion surrounding the right end (i.e., output end) as shown of the coplanar line resonator and a linear extension portion extending from the closed loop line portion to the right end (as shown) of substrate 1. The closed loop line portion of output line 5*b* is formed in an approximate rectangle and extends transversely across center conductor 4 near the right end thereof. A position where the top portion, namely, the closed loop line portion transverses center conductor 4 through substrate 1 is defined as transverse portion X. In FIGS. 1A and 1B, transverse portion X is positioned at the output end side rather than the midpoint of center conductor 4.

In this arrangement, by the electric field and the magnetic field generated at the input end side of the coplanar line resonator and generated between center conductor 4 and ground conductor 2, input line 5*a* electromagnetically couples with the resonator. By the electric field and the magnetic field generated at the both end sides of the transverse portion X in output line 5*b* and generated between center conductor 4 and ground conductor 2, output line 5*b* electromagnetically couples with the resonator. As shown, electric field components are indicated by arrows. With this electromagnetic coupling, high-frequency components propagating to the coplanar line resonator from input line 5*a* are filtered by the coplanar line resonator, and filtered high-frequency components are obtained in output line 5*b*. When the position of transverse portion X is close to the output end of center conductor 4, as a high-frequency filter, it is possible to obtain a band characteristic (resonance characteristic) of a single peak characteristic in which center frequency f0 is regarded as the center, as indicated by curve A in FIG. 2.

Now, since the closed loop line portion of output line 5*b* transverses center conductor 4, another boundary condition is generated in the coplanar line resonator. Transverse portion X in the closed loop line portion is overlapped with center conductor 4 to be electrically coupled. Since this coupling is capacitive coupling, in view of transverse portion X, this coupling is equivalent to that microstrip lines are respectively connected to input/output end sides of center conductor 4. Therefore, for example, the output side of center conductor 4, namely, an electrical open end of the coplanar line resonator is provided with an electric length based on distance d1 to the output end as the microstrip line. When considerations are given to frequency f1 in which distance d1 is set as one-quarter wavelength, this microstrip line functions as an electrical short-circuited end for frequency f1.

FIG. 3 shows an equivalent circuit of the above-mentioned high-frequency filter. When an input point of input line 5*a* is represented by Vin and an output point of output line 5*b* is represented by Vout, first resonance circuit Zf0 by the coplanar line resonator is serially connected as a serial arm between input terminal Vin and output terminal Vout, and second resonance circuit Zf1 generated by the fact that the closed loop line portion crosses center conductor 4 at transverse portion X is connected as a parallel arm between the output side of first resonance circuit Zf0 and a ground potential point. In FIG. 3, both resonance circuits are represented by LCR serial circuits. A frequency at a serial arm resonance point by first resonance circuit Zf0, namely, a resonance frequency is f0, and a frequency at a parallel arm resonance point by second resonance circuit Zf1 is f1. In second resonance circuit Zf1, the current is maximized at frequency f1 in which distance d1 between transverse portion X and the output side end of center conductor 4 is one-quarter wavelength. Consequently, as indicated by curve C in FIG. 2, attenuation pole P occurs in a band characteristic as the high-frequency filter.

In this arrangement, since transverse portion X is positioned at the output end side rather than the midpoint of center conductor 4, distance d1 between transverse portion X and the output side end of center conductor 4 is shorter than $\lambda/4$ when a wavelength corresponding to center frequency f0 is $\lambda$. As a result, parallel arm resonance point f1 by distance d1 is higher than the serial arm resonance point, namely, center frequency f0. Attenuation pole P by parallel arm resonance point f1 is formed in the higher-frequency range than center frequency f0 in the band characteristic of the high-frequency filter, makes an attenuation gradient of the band characteristic steeper and makes a passband width, in which, for example, the attenuation amount is in a range from the passband peak value to 3 dB, narrows. Therefore, an apparent Q value of the high-frequency filter is increased.

On the other hand, at one side (i.e., input end side) of center conductor 4, since center conductor 4 electromagnetically couples with input line 5*a*, the input end side of center conductor 4 viewed from transverse portion X is not electrically short-circuited end. When a distance from transverse portion X to the input end of center conductor 4 is represented by d2, d2>$\lambda/4$ is satisfied. When a frequency in which distance d2 is one-quarter wavelength is represented by f2, ripple P' regarding f2 as the parallel arm resonance point generates in the band characteristic of the high-frequency filter, however, is inadequate to form attenuation pole P distinctly at f2.

The above description relates to the case in which transverse portion X is positioned between the midpoint and the output end of center conductor 4. When transverse portion X is positioned between the midpoint and the input end of center conductor 4, namely, when distance d1 is longer than $\lambda/4$, an attenuation pole by parallel arm resonance point f1 occurs in the lower-frequency range than center frequency f0.

According to the above description, in the high-frequency filter, output line 5*b* is formed in the closed loop line while input line 5*a* is linearly formed. However, an input line may be formed in a closed loop line and an output line may be formed in a linear transmission line, and an attenuation pole is also formed in this case similarly to the above description. Further, both of an input line and an output line may be formed in closed loop lines. When both of the input line and the output line are formed in closed loop lines, a distance between a transverse portion in each closed loop line portion and a corresponding end in the center conductor is shorter than the half length of the center conductor, and therefore each attenuation pole by each closed loop line portion occurs in the higher-frequency range than center frequency f0.

In the conventional high-frequency filter using the single coplanar line resonator as described above, attenuation pole P generated by the closed loop line portion in the output line is principally formed in either one of the higher-frequency range or the lower-frequency range with respect to center frequency f0 of the coplanar line resonator. As a result, it is difficult to make the passband width of the high-frequency filter narrow and to increase the Q value by arranging attenuating poles at both of the high-frequency range and the low-frequency range around center frequency f0. Also, when the attenuation pole is formed, as shown in FIG. 2, the attenuation amount increases by $\alpha(>0)$ at center frequency f0 of the passband compared with a case where no attenuation pole is formed, and there is a problem in which an insertion loss increases correspondingly.

SUMMARY OF THE INVENTION

Accordingly, it is an object of the present invention to provide a high-frequency filter capable of forming a plurality of attenuation poles in a band characteristic and capable of reducing an insertion loss.

It is another object of the present invention to provide a high-frequency filter of a variable frequency type, capable of forming a plurality of attenuation poles in a band characteristic and capable of reducing an insertion loss.

The objects of the present invention is attained by a high-frequency filter including: a substrate; a ground conductor disposed on one main surface of the substrate and having an opening; a center conductor disposed on one main surface of the substrate in the opening and making up a coplanar line resonator of a coplanar structure together with the substrate and the ground conductor; an input line of a microstrip line structure, disposed on the other main surface of the substrate and electromagnetically coupling with one end of the center conductor; and an output line of a microstrip line structure, disposed on the other main surface of the substrate and electromagnetically coupling with the other end of the center conductor: wherein at least one of the input line and the output line has a closed loop line portion surrounding a corresponding end of the center conductor and crossing the center conductor transversely through the substrate; and wherein on the other main surface of the substrate, a stub overlapping with the center conductor is arranged from a transverse position where the closed loop line portion crosses the center conductor.

With this arrangement, as described above, relative to the center frequency (i.e., serial arm resonance point) by the coplanar line resonator, the parallel arm resonance point regarding the electric length based on the distance between the transverse portion in the closed loop line portion and one end or the other end of the center conductor as one-quarter wavelength occurs. Therefore, the first attenuation pole is formed in the transmission characteristic as the filter. Further, the stub extending from the transverse portion in the closed loop line portion is arranged, the other end side of the stub viewed from the transverse portion is the short-circuited end relative to the frequency regarding the electric length based on the length of the stub as one-quarter wavelength, and the parallel arm resonance point regarding the electric length based on the length of the stub as one-quarter wavelength occurs. Therefore, in the transmission characteristic, the second attenuation pole based on the stub is newly formed.

In the high-frequency filter according to the present invention, two attenuation poles can be thus established in the band characteristic as the filter. Also, in accordance with the positions of the first and second attenuation poles, it is possible to make the attenuation gradient of the band characteristic steeper or to increase the guarantee attenuation amount out of the band. For example, it is possible to make the attenuation gradient still steeper by arranging the first and second attenuation poles at the same position in the higher-frequency range than the center frequency in the band characteristic of the coplanar line resonator. Also, in the higher-frequency range than the center frequency, the first and second attenuation poles are formed at different positions, thereby increasing the guarantee attenuation amount out of the band. Further, the first and second attenuating poles are formed at both sides around the center frequency, thereby making the attenuation gradient at both sides of the center frequency steeper and increasing the apparent Q value of the filter.

According to the present invention, the stub is overlapped with the center conductor of the coplanar line resonator through the substrate. As a result, since the stub is capacitive-coupled with the center conductor, the level of the high-frequency signal to be outputted is increased and the insertion loss in the transmission characteristic as the filter, in particular, at the center frequency in the band characteristic can be reduced.

Also, with one substrate, a plurality of high-frequency filters according to the present invention may be cascade-connected. In this case, when the resonance frequencies of the respective coplanar line resonators are set to be equal, the cascade-connection allows the attenuation gradient of the band characteristic to be still steeper and the apparent Q value to be increased. Further, when the resonance frequencies of the coplanar line resonators are set to be different, the band width can be made wider.

DESCRIPTION OF THE PREFERRED EMBODIMENTS

Figure 1A:
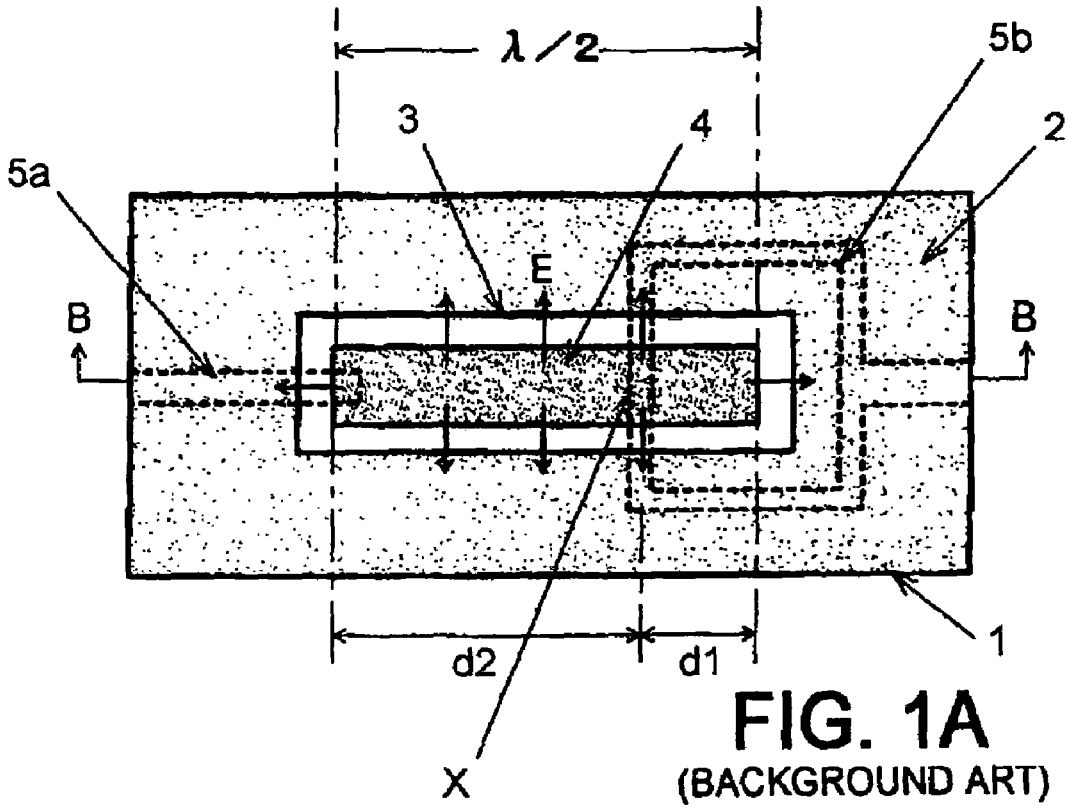
FIG. 1A (BACKGROUND ART)
FIG. 1A is a schematic plan view showing a conventional high-frequency filter.
Figure 1B:
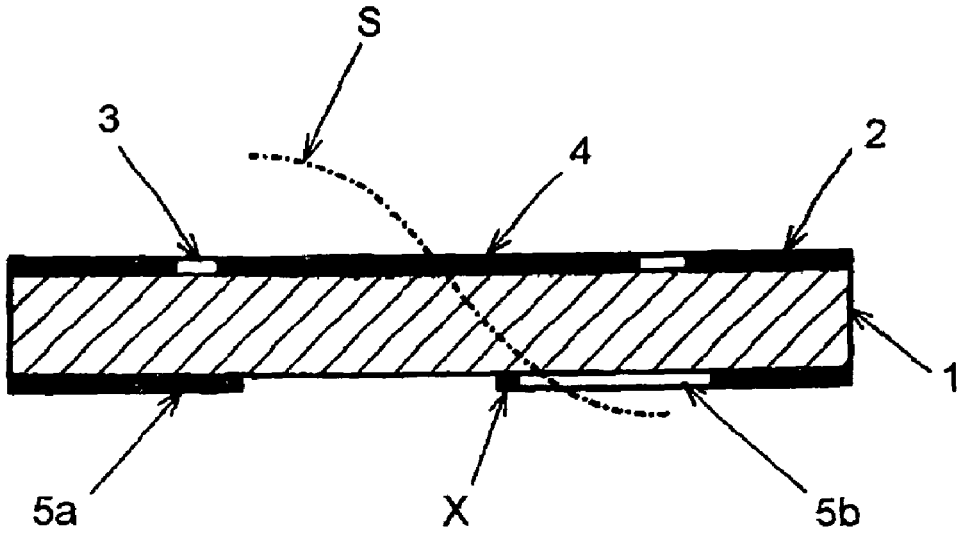
FIG. 1B (BACKGROUND ART)
FIG. 1B is a cross-sectional view taken along line B-B in FIG. 1A.
Figure 2:
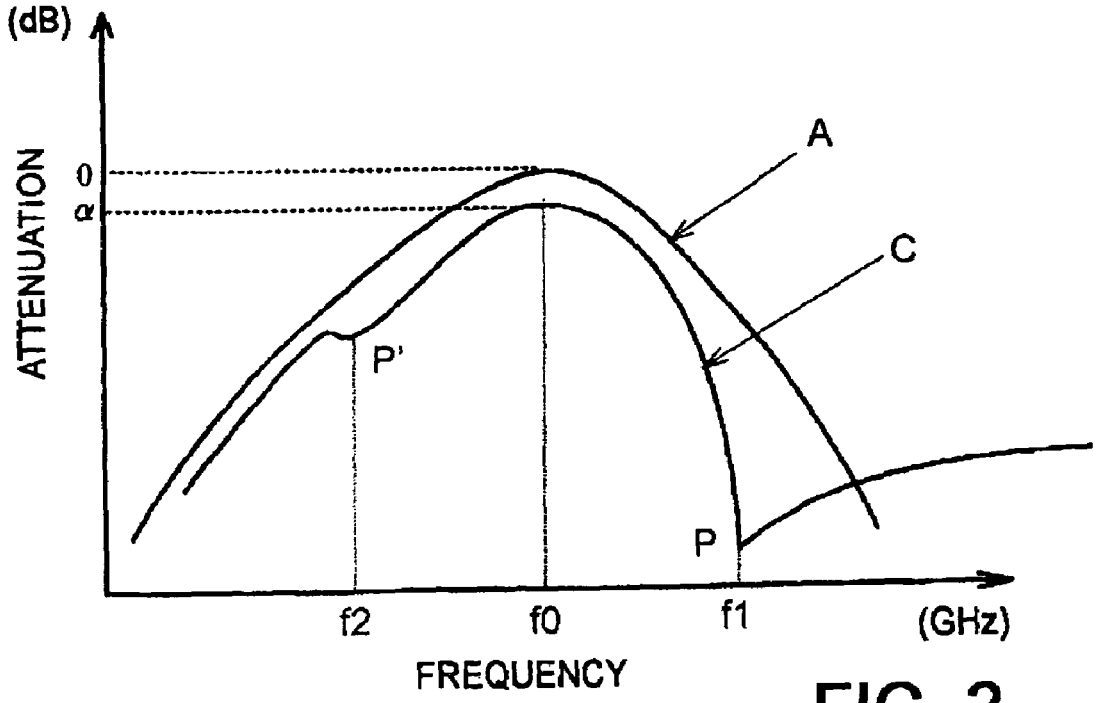
FIG. 2 (BACKGROUND ART)
FIG. 2 is a graph showing band characteristics of the high-frequency filter shown in FIGS. 1A and 1B.
Figure 3:
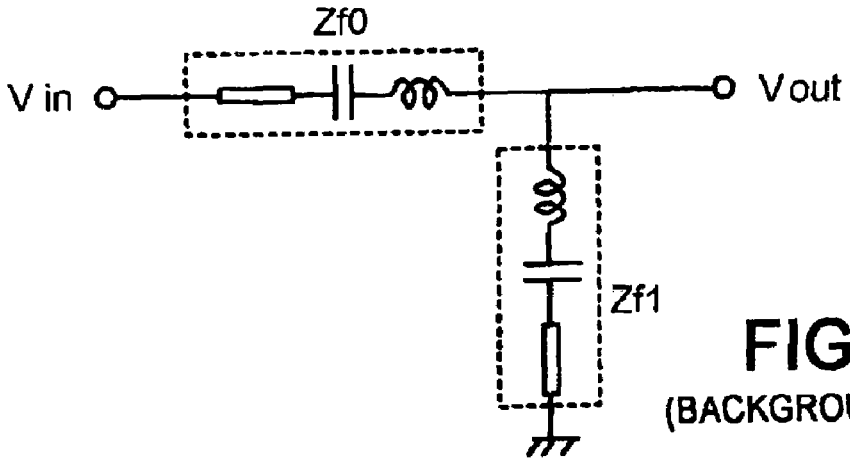
FIG. 3 (BACKGROUND ART)
FIG. 3 is an electrical equivalent circuit diagram of the high-frequency filter shown in FIGS. 1A and 1B.
Figure 4A:
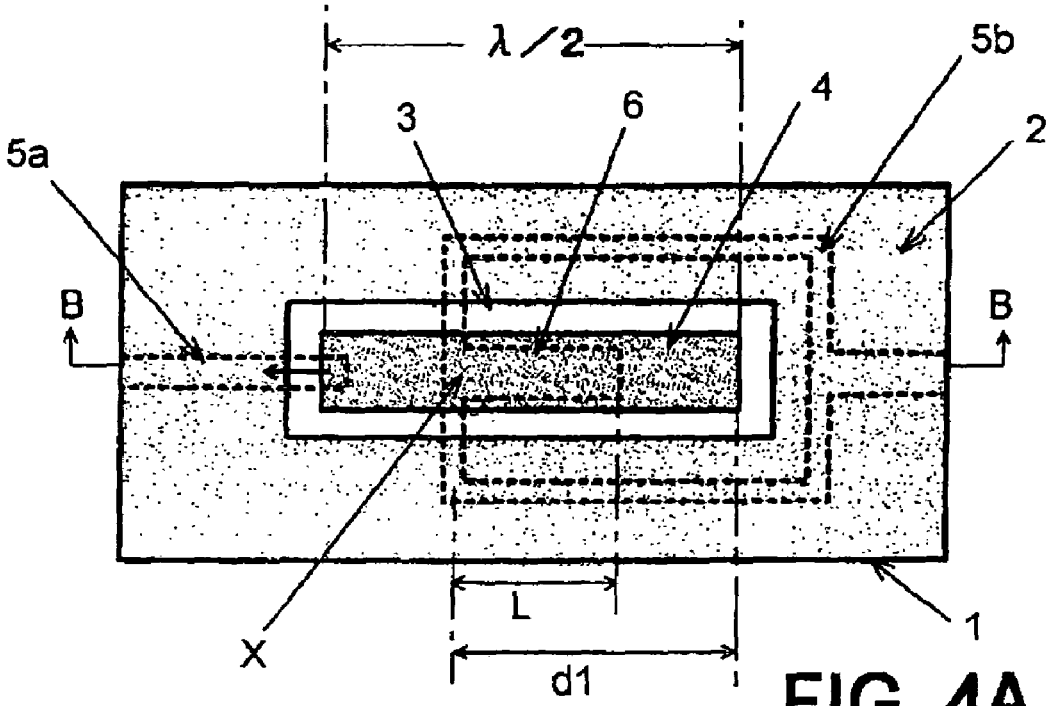
FIG. 4A is a plan view showing a high-frequency filter according to a first embodiment of the present invention.
Figure 4B:
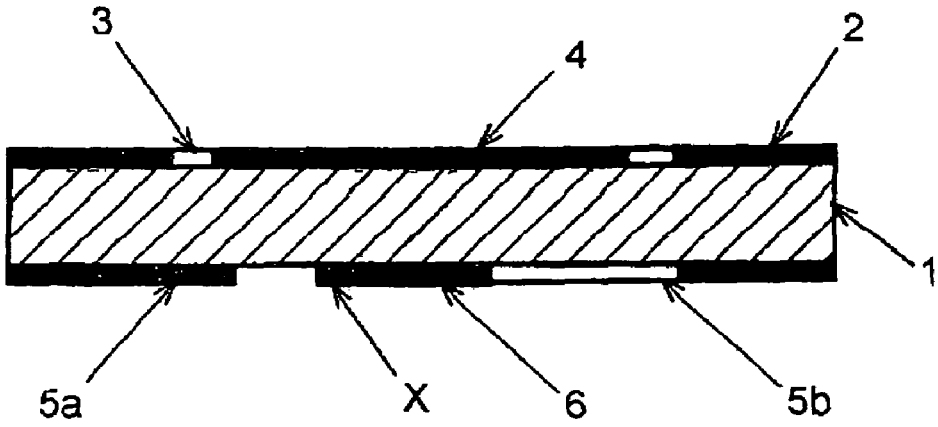
FIG. 4B is a cross-sectional view taken along line B-B in FIG. 4A.

In FIGS. 4A and 4B showing a high-frequency filter according to a first embodiment of the present invention, the same reference numerals are applied to the same constituents as those in FIGS. 1A and 1B, and redundant explanations thereof are simplified.

The high-frequency filter shown in FIGS. 4A and 4B includes a coplanar line resonator of a coplanar structure. Ground conductor 2 is disposed on one main surface of substrate 1 made of a dielectric material, and rectangular opening 3 is formed in ground conductor 2. In opening 3, center conductor 4 extending in the longitudinal direction of opening 3 is arranged on one main surface of substrate 1. Both ends of center conductor 4 are open ends. When the center frequency of the high-frequency filter, namely, the resonant frequency of the coplanar line resonator is represented by f0 and a wavelength corresponding to f0 is represented by λ, the length of center conductor 4 is approximately λ/2. Substrate 1, ground conductor 2, opening 3, and center conductor 4 make up the coplanar line resonator.

Input line 5*a* is arranged on the other main surface of substrate 1 so as to correspond to an input end of center conductor 4. Input line 5*a* includes a linear transmission line extending from a left end (as shown) and is overlapped with one end side (i.e., input side) of center conductor 4 through substrate 1 so as to be electromagnetically coupled. On the other hand, output line 5*b* includes a closed loop line portion surrounding a right end (i.e., output end) as shown of the coplanar line resonator and an extension portion extending from the closed loop line portion to the right end (as shown) of substrate 1. The closed loop line portion of output line 5*b* is formed in an approximate rectangle and extends transversely across center conductor 4. A position where the closed loop line portion of output line 5*b* transversely crosses center conductor 4 is defined as transverse portion X.

In the high-frequency filter according to the first embodiment, differently from that shown in FIGS. 1A and 1B, the closed loop line portion of output line 5*b* crosses center conductor 4 at the input end side rather than the midpoint of center conductor 4 of the coplanar line resonator. As a result, distance d1 between transverse portion X and the output end of center conductor 4 is longer than the half length of center conductor 4, namely, λ/4. At the position of transverse portion X, stub 6 extends from output line 5*b* to the output end side of center conductor 4. Stub 6 is formed on the other main surface of substrate 1 so as to be overlapped with center conductor 4 through substrate 1. Length L of stub 6 is shorter than the half length of center conductor 4. In other words, the electric length of stub 6 is shorter than one-quarter of wavelength λ corresponding to center frequency f0.

In the high-frequency filter, in accordance with distance d1 between transverse portion X of output line 5*b* and the output end of center conductor 4, contrary to the case shown in FIGS. 1A and 1B, first attenuation pole P appears in the band characteristic at f1 which is a frequency in the lower-frequency range than center frequency f0. Also, viewed from transverse portion X, the top side of stub 6 functions as an electrical short-circuited end relative to frequency f2 which the electric length based on length L of stub 6 is one-quarter wavelength. In the high-frequency filter, a parallel arm in which frequency f2 is regarded as a resonance point is connected to a serial arm by the coplanar line resonator. Therefore, in the band characteristics of the high-frequency filter, second attenuation pole P2 by parallel arm resonant point f2 occurs. In this case, length L of stub 6 is shorter than λ/4 when a wavelength corresponding to center frequency f0 is λ. Therefore, frequency f2 of second attenuation pole P2 is in the higher-frequency range than center frequency f0.

Figure 5:
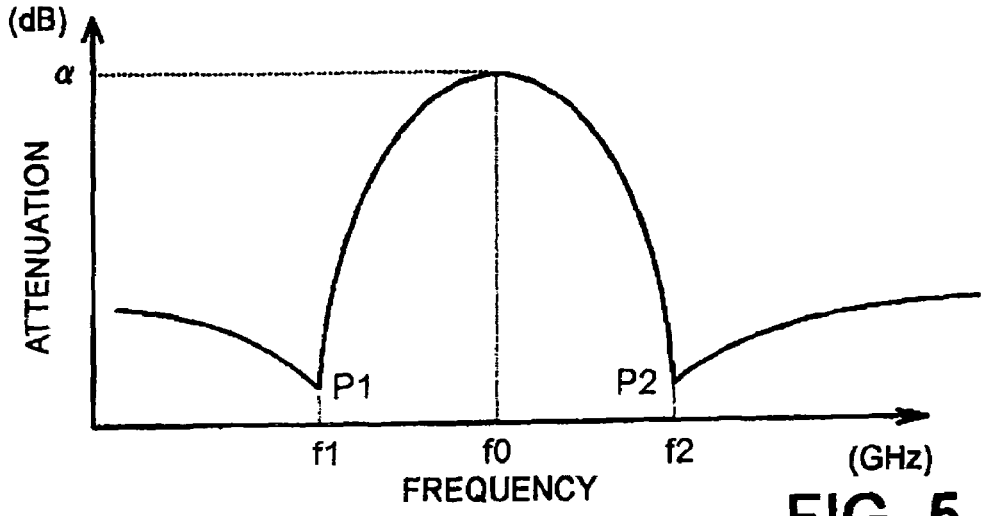
FIG. 5 is a graph showing a band characteristic of the high-frequency filter shown in FIGS. 4A and 4B.

Consequently, in this high-frequency filter, as shown in FIG. 5, in the band characteristic thereof, first attenuation pole P1 and second attenuation pole P2 are formed at both sides around center frequency f0. Attenuation poles P1 and P2 are arranged at both sides of center frequency f0 in this way, and therefore the attenuation gradient is made steeper in the band characteristics of the high-frequency filter. As a result, the passband width, in which, for example, the attenuation amount is in a range from the passband peak value to 3 dB, is made narrow, and the apparent Q value is increased. Also, since stub 6 arranged on the other main surface of substrate 1 is overlapped with center conductor 4 arranged on one main surface of substrate 1 through substrate 1 so as to be capacitive-coupled, output line 5*b* is coupled with center conductor 4 by this capacitive-coupling in addition to electromagnetic-coupling in transverse portion X. As a result, in the high-frequency filter, it is possible to heighten the level of the high-frequency component at center frequency f0 appearing in output line 5*b* and to reduce the insertion loss compared with the conventional one.

Figure 6A:
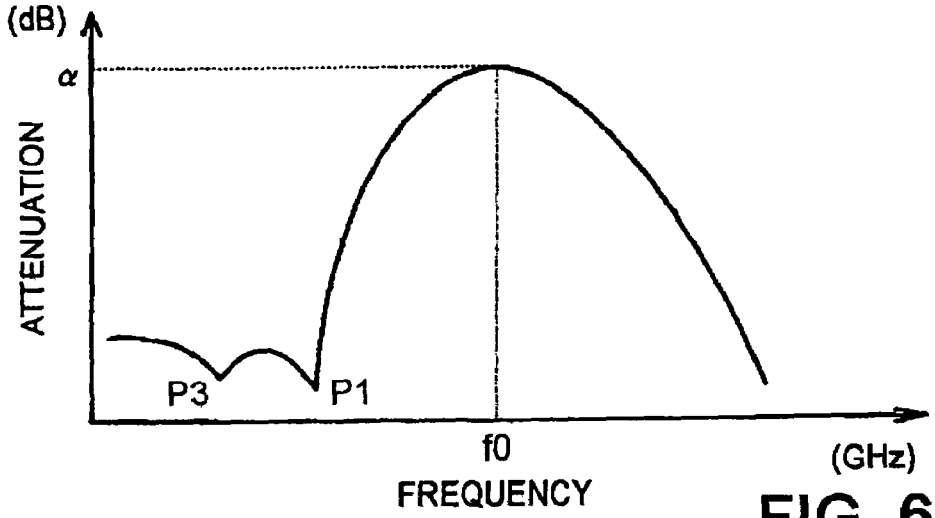
FIGS. 6A and 6B are graphs showing band characteristics in a case where a length of a stub and a position of a transverse portion are changed in the high-frequency filter shown in FIGS. 4A and 4B.

In the above-mentioned high-frequency filter, it is possible to vary band characteristics by changing the length of stub 6 of by changing the position of transverse portion X. For example, in the high-frequency filter shown in FIGS. 4A and 4B, considerations are given to a case in which length L of stub 6 is larger than λ/4. In this case, as shown in FIG. 6A, both of attenuation pole P1 based on distance d1 between transverse portion X and the output end and attenuation pole P3 based on stub 6 appear in the lower-frequency range than center frequency f0. When two attenuation poles are in the lower-frequency range than center frequency f0 in this like, an attenuation gradient is made steeper, particularly in the low-frequency range in the band characteristics of the filter.

Figure 6B:
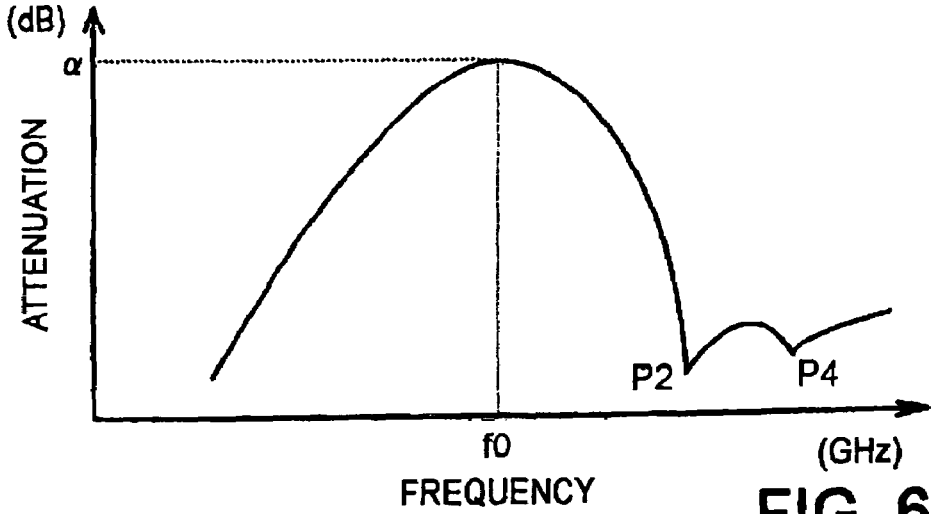

On the other hand, considerations are given to a case in which transverse portion X where output line 5*b* transversely crosses center conductor 4 is positioned at the output end side rather than the midpoint of center conductor 4, namely, distance d1 is shorter than λ/4. In this case, as shown in FIG. 6B, both of attenuation pole P2 based on stub 6 and attenuation pole P4 based on distance d1 appear in the higher-frequency range than center frequency f0. When two attenuation poles are in the higher-frequency range than center frequency f0 in this like, an attenuation gradient is made steeper, particularly in the high-frequency range in the band characteristic of the filter.

The configuration of the high-frequency filter according to the first embodiment is not limited to that shown in FIGS. 4A and 4B. Other examples of high-frequency filters according to the first embodiment are explained below.

Figure 7A:
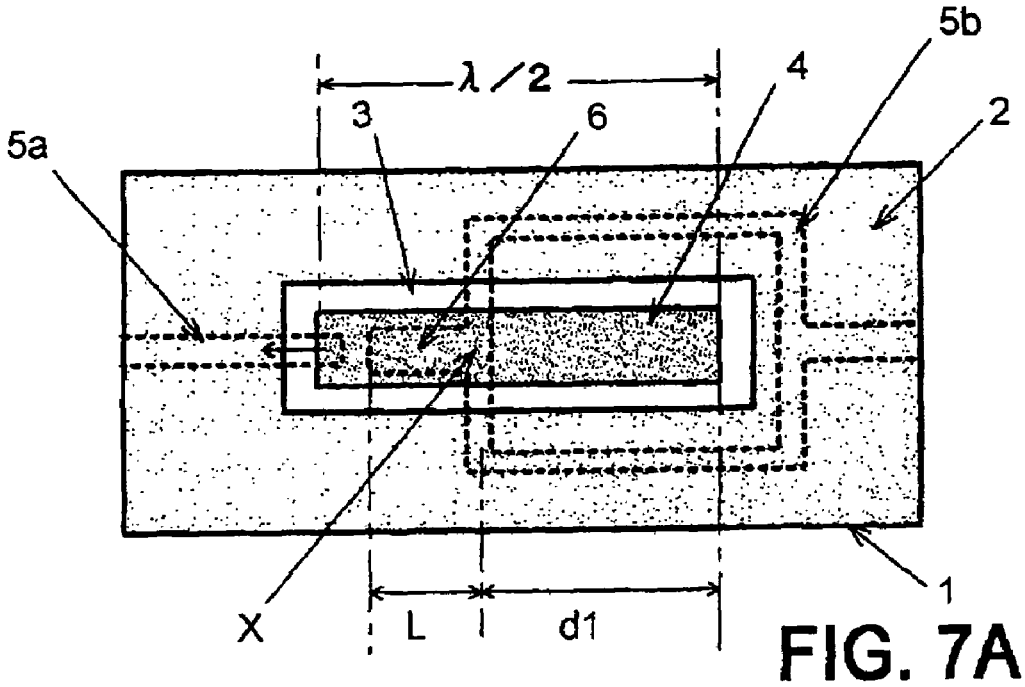
FIGS. 7A and 7B are plan views respectively showing other examples of the high-frequency filter according to the first embodiment.

In a high-frequency filter shown in FIG. 7A, on the other main surface of substrate 1, stub 6 extends from transverse portion X in output line 5*b* not in the direction of the output end but toward the input end of center conductor 4. In this case, by making length L of stub 6 shorter than λ/4 when the wavelength corresponding to center frequency f0 is represented by λ, similarly to that shown in FIGS. 4A and 4B, attenuation poles P1 and P2 respectively appear in both of the low-frequency range and the high-frequency range around center frequency f0 in the band characteristic.

Figure 7B:
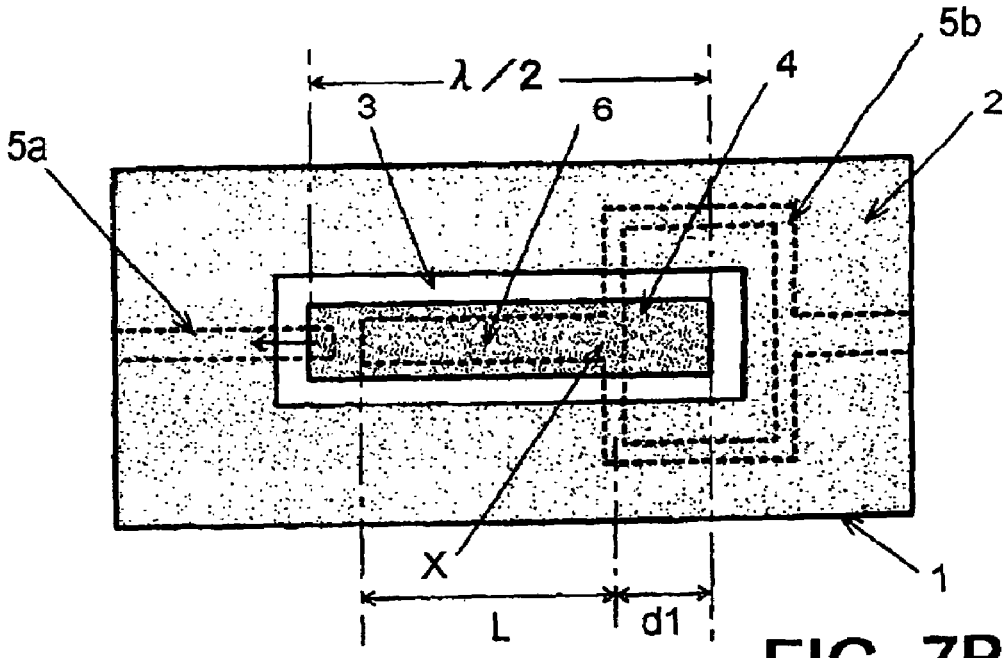

In a high-frequency filter shown in FIG. 7B, on the other main surface of substrate 1, stub 6 also extends from transverse portion X to the input end side, however, stub 6 is different from that in FIG. 7A in length L of stub 6 and the position of transverse portion X. In the high-frequency filter shown in FIG. 7B, length L of stub 6 is longer than λ/4 while distance d1 between transverse portion X and the output end of center conductor 4 is shorter than λ/4. In this case, an attenuation pole by stub 6 appears in the lower-frequency range than center frequency f0, and an attenuation pole based on distance d1 appears at the higher-frequency range than center frequency f0. In this case, each one attenuation pole appears in each of the low-frequency range and the high-frequency range around center frequency f0.

Figure 8:
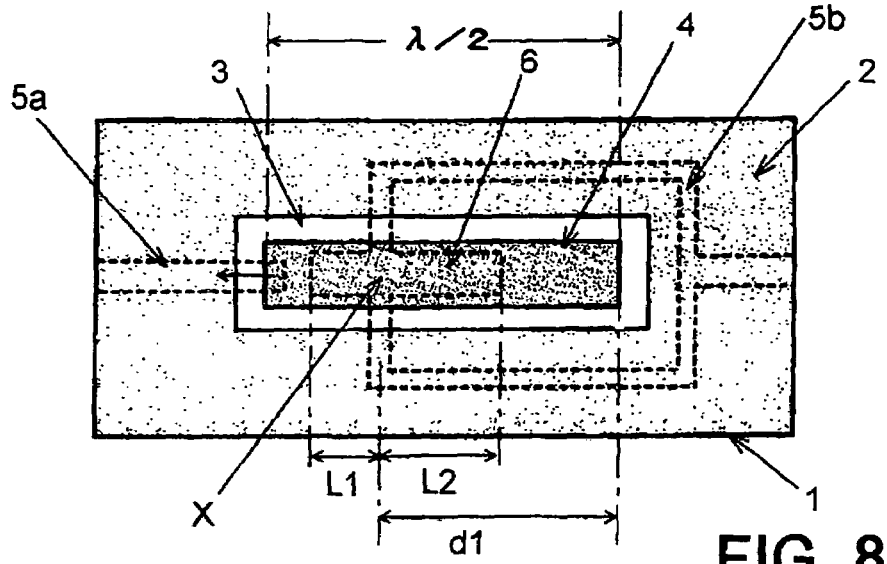
FIG. 8 is a plan view showing further another example of the high-frequency filter according to the first embodiment.
Figure 9A:
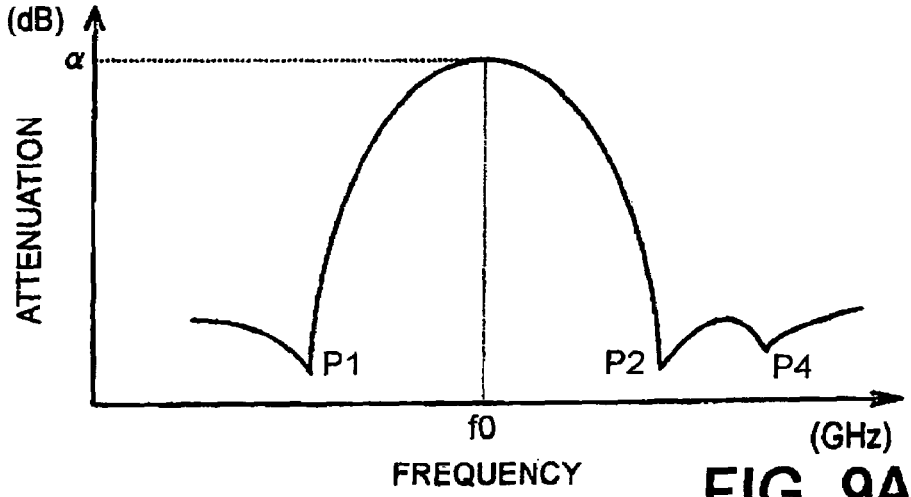
FIG. 9A is a graph showing a band characteristic of the high-frequency filter shown in FIG. 5 in a case of $L1<L2<\lambda/4$.

In a high-frequency filter shown in FIG. 8, stub 6 is arranged in the high-frequency filter shown in FIGS. 4A and 4B so as to extend from transverse portion X to both of the input end side and the output end side of center conductor 4. In this description, in stub 6, a length of a portion extending from transverse portion X to the input end side is represented by L1, and a length of a portion extending from transverse portion X to the output end side is represented by L2. When both of L1 and L2 are shorter than λ/4, as shown in FIG. 9A, both of attenuation pole P2 by the portion of the output end side in stub 6 and attenuation pole P4 by the portion of the input end side appear in the higher-frequency range than center frequency f0. Attenuation pole P1 by distance d1 between transverse portion X and the output end appears in the low-frequency range. Two attenuation poles appear in the high-frequency range like this, thereby increasing the guarantee attenuation amount out of the passband in the high-frequency range. Particularly, when L1=L2<λ/4 is satisfied, attenuation poles P2 and P4 degenerate to have larger attenuation amounts. Therefore, it is possible to make the attenuation gradient in the high-frequency range still steeper.

Figure 9B:
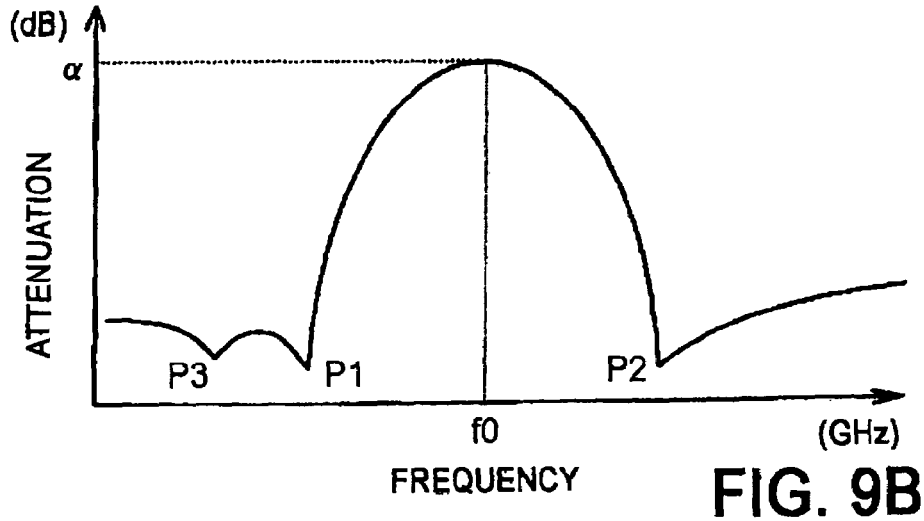
FIG. 9B is a graph showing a band characteristic of the high-frequency filter shown in FIG. 5 in a case of $L2<\lambda/4<L1$.

Further, when the length of portion L2 at the output end side in stub 6 is longer than λ/4, attenuation pole P3 by this portion appears in the lower-frequency range than center frequency f0. Therefore, as shown in FIG. 9B, two attenuation poles P1 and P3 appear in the low-frequency range. In this case, it is possible to increase the guarantee attenuation amount out of the passband in the low-frequency range.

In the above-mentioned high-frequency filter according to the first embodiment, output line 5*b* is formed in the closed loop line, and input line 5*a* is linearly formed. However, an input line may be formed in a closed loop line and an output line may be formed linearly. In this case, a stub is arranged in the input line. Also, both of input and output lines may be formed in closed loop lines. When both of the input and output lines are formed in closed loop lines, stubs may be arranged in both of the input and output lines, and may be arranged in one of them.

Figure 10A:
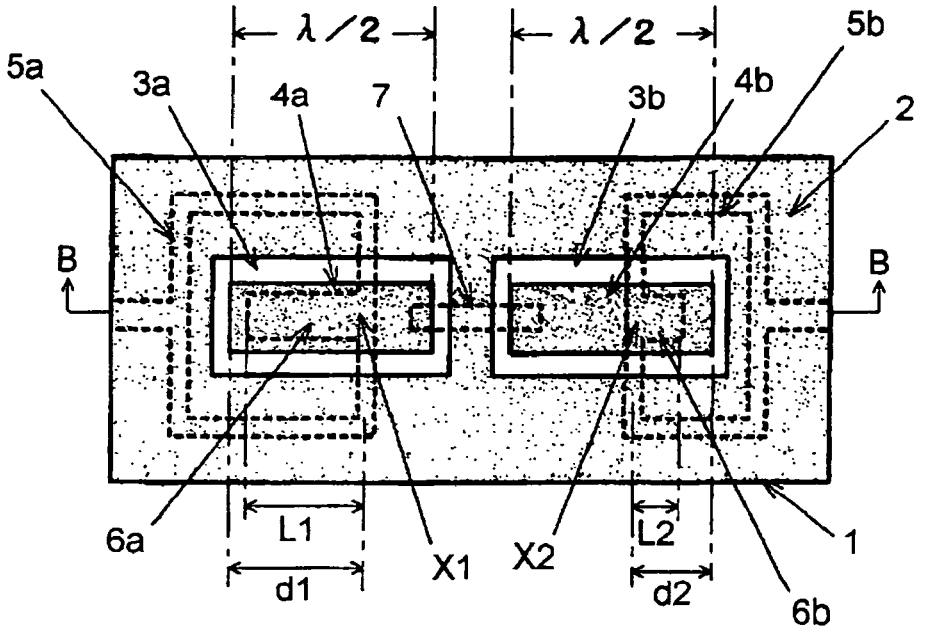
FIG. 10A is a plan view showing a high-frequency filter according to a second embodiment of the present invention.
Figure 10B:
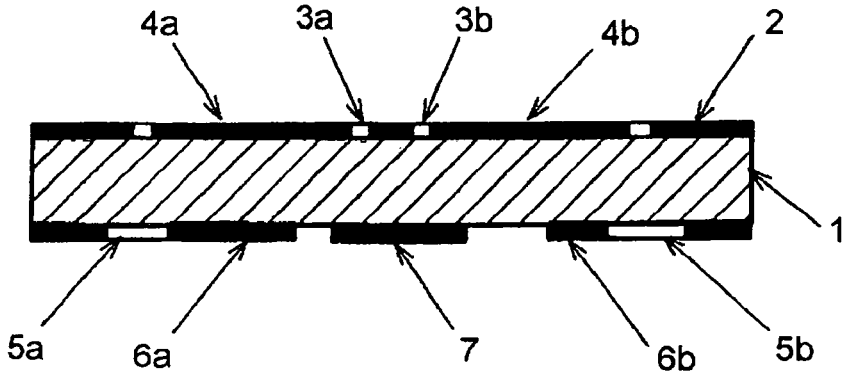
FIG. 10B is a cross-sectional view taken along line B-B in FIG. 10A.

Next, explanations are given of a high-frequency filter according to a second embodiment of the present invention. The high-frequency filter according to the second embodiment is provided with a configuration in which the above-mentioned high-frequency filters according to the first embodiment are cascade-connected in multi-stages by employing one substrate 1. In FIGS. 10A and 10B showing the high-frequency filter according to the second embodiment, the same reference numerals are applied to the same constituents as those in FIGS. 4A and 4B, and redundant explanations thereof are simplified.

In ground conductor 2 disposed on one main surface of substrate 1 made of a dielectric material, two rectangular openings 3*a*, 3*b* are formed. In openings 3*a*, 3*b*, center conductors 4*a*, 4*b* are respectively arranged. First coplanar line resonator is made from opening 3*a* and center conductor 4*a*, and second coplanar line resonator is made from opening 3*b* and center conductor 4*b*. The first and second coplanar line resonators are arranged in a line along the longitudinal direction thereof. A wavelength corresponding to the resonance frequency (i.e., center frequency) f0 of the high-frequency filter is represented by λ, and both the electric lengths of center conductors 4*a*, 4*b* are set to λ/2.

At the input end of the first coplanar line resonator at the left side as shown, input line 5*a* having a closed loop line portion is arranged on the other main surface of substrate 1, and at the output end of the second coplanar line resonator at the right side as shown, output line 5*b* having a closed loop line portion is arranged on the other main surface of substrate 1. The output end of the first coplanar line resonator and the input end of the second coplanar line resonator are electromagnetically coupled by an input/output connection line made from a linear microstrip line arranged on the other main surface of substrate 1. In this way, according to the second embodiment, the high-frequency filters including the first and second coplanar line resonators are cascade-connected.

In input line 5*a* electromagnetically coupling with the first coplanar line resonator, stub 6*a* is arranged so as to overlap with center conductor through substrate 1 from transverse portion X1, at which the closed loop line portion transversely crosses center conductor 4*a*, toward the input end side of center conductor 4*a*. When a distance between transverse portion X1 and the input end of center conductor 4*a* is represented by d1 and the length of stub 6*a* is, represented by L1, d1>L1>λ/4 is satisfied. In output line 5*b* electromagnetically coupling with the second coplanar line resonator, stub 6*b* is arranged so as to overlap with center conductor 4*b* through substrate 1 from transverse portion X2, at which the closed loop line portion transversely crosses center conductor 4*b*, toward the output end side of center conductor 4*b*. When a distance between transverse portion X2 and the output end of center conductor 4*b* is represented by d2 and the length of stub 6*b* is represented by L2, L2<d2<λ/4 is satisfied.

Figure 11:
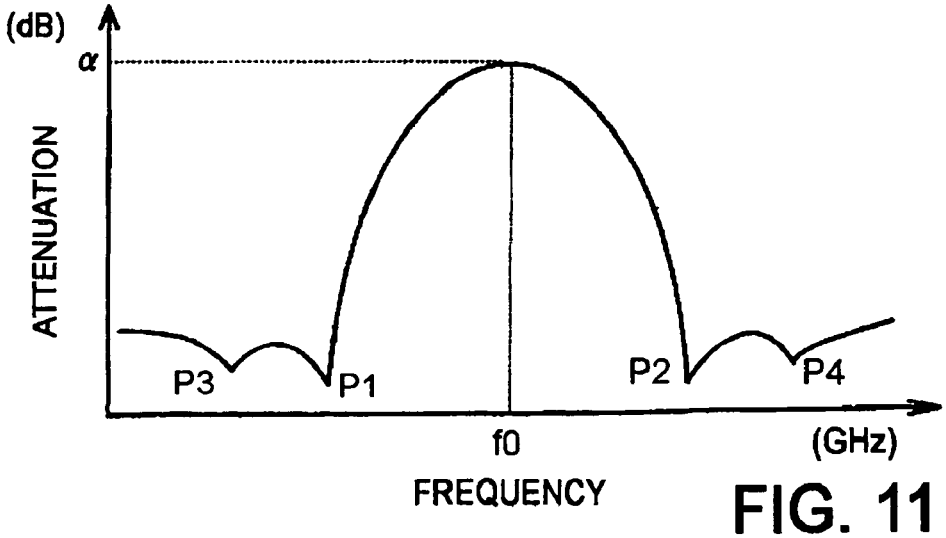
FIG. 11 is a graph showing band characteristics of the high-frequency filter shown in FIGS. 10A and 10B.

With this arrangement, in the band characteristics of the high-frequency filter, as shown in FIG. 11, third attenuation pole P3 is formed in the lower-frequency range than center frequency f0 by distance d1 between transverse portion X1 and the input end of the first coplanar line resonator, and first attenuation pole P1 by stub 6*a* of which the length is L1 is formed closer to center frequency f0 than third attenuation pole P3. Also, second attenuation pole P2 is formed in the higher-frequency range than center frequency f0 by distance d2 between transverse portion X2 and the output end of the second coplanar line resonator, and fourth attenuation pole P4 is formed in the still higher-frequency range by stub 6*b* of which the length is L2.

In the multi-stage high-frequency filter like this, attenuation gradients at both sides of center frequency f0 can be made steeper and the passband can be made narrow, thereby increasing the apparent Q value. Also, since stubs 6*a*, 6*b* and center conductors 4*a*, 4*b* are capacitive-coupled, insertion loss a as the high-frequency filter can be reduced. Since two attenuation poles P1, P3 are formed in the low-frequency range and two attenuation poles P2, P4 are formed in the high-frequency range, it is possible to increase the guarantee attenuation amount out of the band.

In the configuration shown in FIGS. 10A and 10B, two coplanar line resonators are electromagnetically coupled by the linear input/output connection line. However, a configuration for interconnecting coplanar line resonators is not limited to the above-mentioned configuration.

Figure 12A:
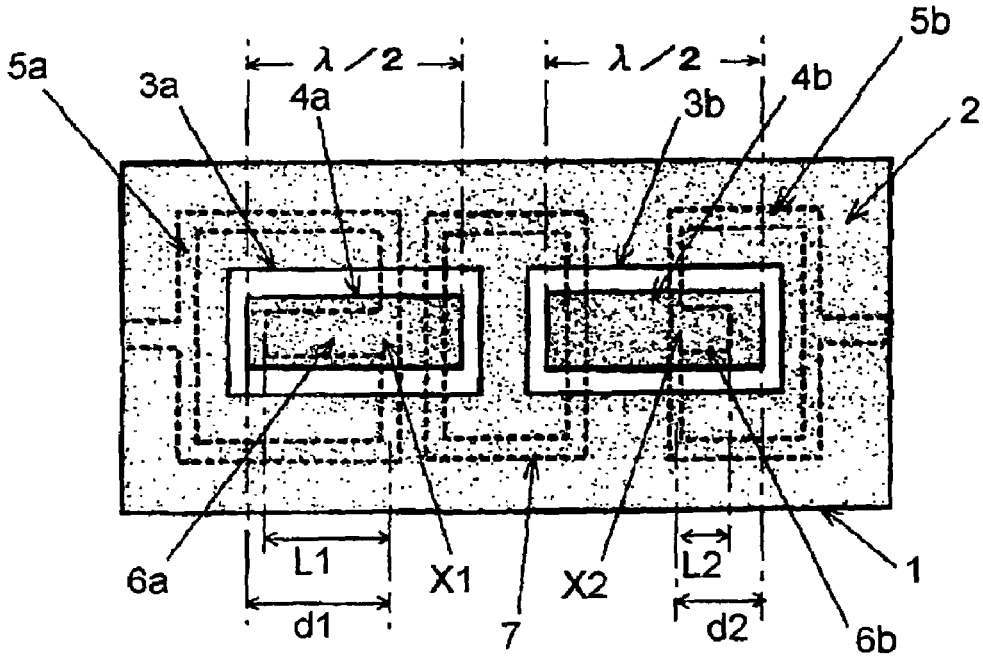
FIGS. 12A to 12D are plan views respectively showing other examples of the high-frequency filter according to the second embodiment.

In a high-frequency filter shown in FIG. 12A, on the other main surface of substrate 1, input/output connection line 7 of a microstrip line structure is formed as a closed loop line surrounding both the output end of the first coplanar line resonator and the input end of the second coplanar line resonator.

Figure 12B:
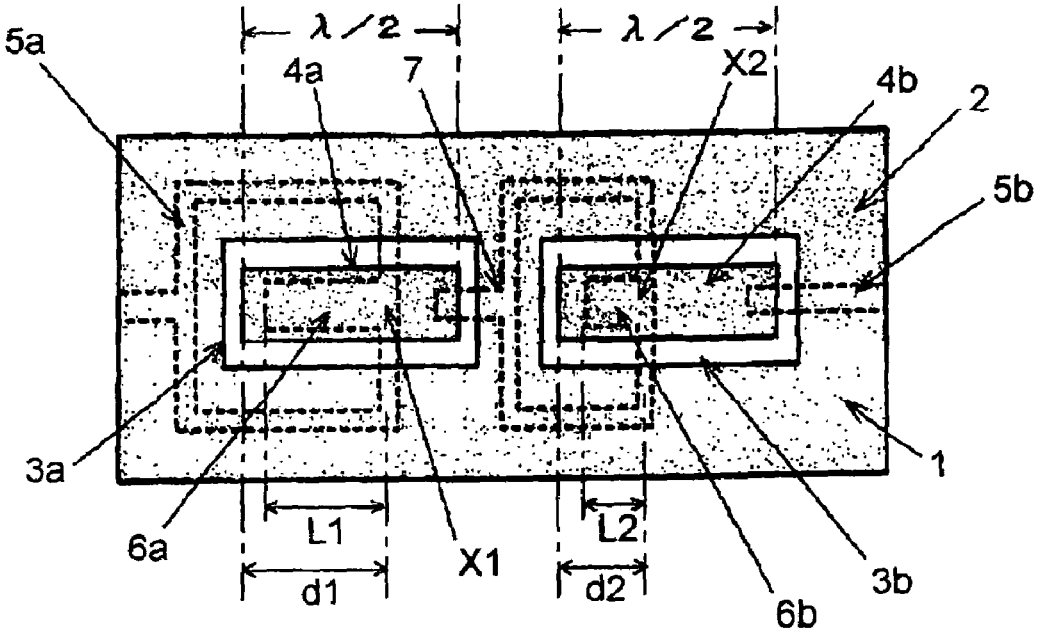

In a high-frequency filter shown in FIG. 12B, a linear line portion electromagnetically coupling with the output end of the first coplanar line resonator and a closed loop line portion surrounding the input end of the second coplanar line resonator are provided, and the linear line portion and the closed loop line portion are connected to form input/output connection line 7 of a microstrip line structure. As output line 5*b* coupling with the output end of the second coplanar line resonator, a linear transmission line is used. When a position where the closed loop line portion in input/output connection line 7 transversely crosses center conductor 4*b* is represented by transverse portion X2, stub 6*b* is arranged from transverse portion X2 to the input end of center conductor 4*b*. In this arrangement, when a distance between transverse portion X2 and the input end of center conductor 4*b* is represented by d2 and the length of stub 6*b* is represented by L2, L2<d2<λ/4 is satisfied.

Figure 12C:
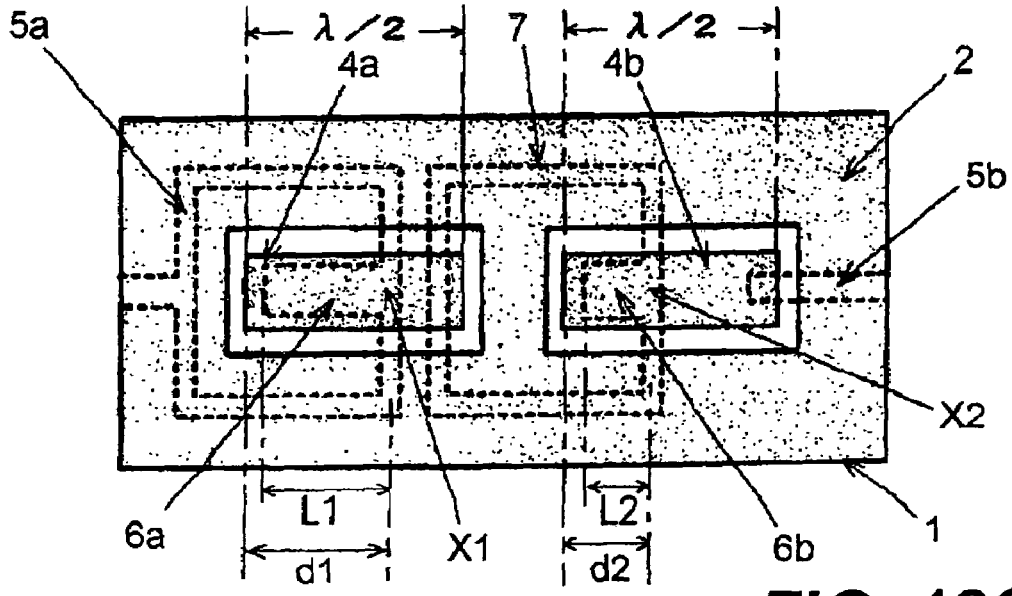

In a high-frequency filter shown in FIG. 12C, on the other main surface of substrate 1, a closed loop line surrounding both the output end of the first coplanar line resonator and the input end of the second coplanar line resonator is formed as input/output connection line 7. As output line 5*b* coupling with the output end of the second coplanar line resonator, a linear line is used. When a position where input/output connection line 7 transversely crosses center conductor 4*b* of the second coplanar line resonator is represented by transverse portion X2, stub 6*b* is arranged from transverse portion X2 to the input end of center conductor 4*b*. In this arrangement, when a distance between transverse portion X2 and the input end of center conductor 4*b* is represented by d2 and the length of stub 6*b* is represented by L2, L2<d2<λ/4 is satisfied. At a position where input/output connection line 7 crosses center conductor 4*a* of the first coplanar line resonator, no stub is arranged.

Figure 12D:
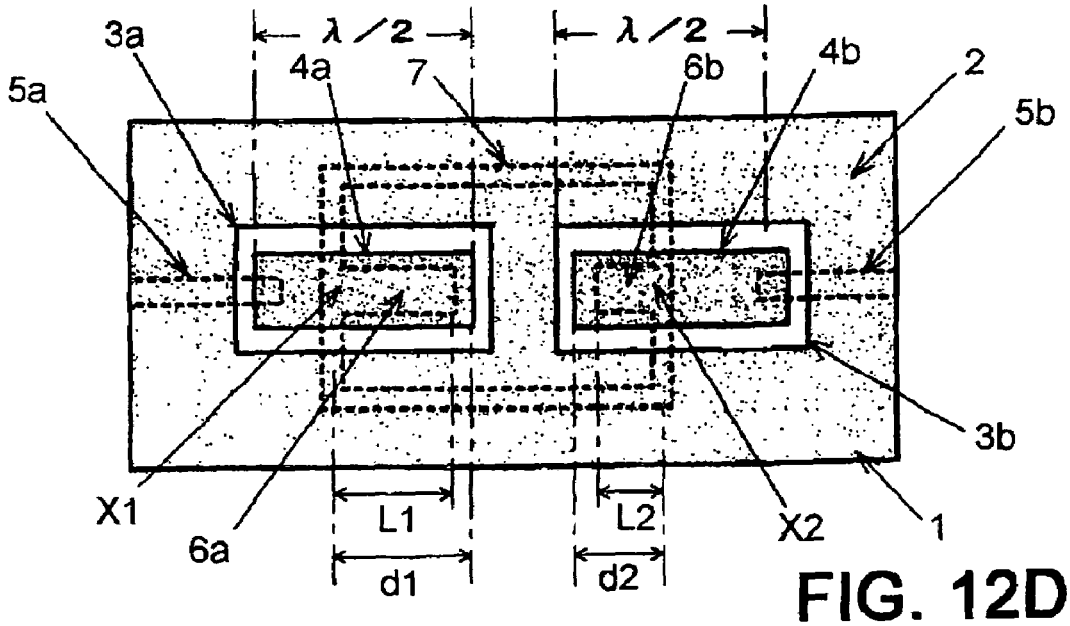

In a high-frequency filter shown in FIG. 12D, on the other main surface of substrate 1, a closed loop line surrounding both the output end of the first coplanar line resonator and the input end of the second coplanar line resonator is formed as input/output connection line 7. For both input line 5*a* coupling with the input end of the first coplanar line resonator and output line 5*b* connecting with the output end of the second coplanar line resonator, linear transmission lines are used. When a position where input/output connection line 7 crosses center conductor 4*a* of the first coplanar line resonator is represented by transverse portion X1, stub 6*a* is arranged from transverse portion X1 to the output end of center conductor 4*a*. In this arrangement, when a distance between transverse portion X1 and the output end of center conductor 4*a* is represented by d1 and the length of stub 6*a* is represented by L1, λ/4<L1<d1 is satisfied. When a position where input/output connection line 7 crosses center conductor 4*b* of the second coplanar line resonator is represented by transverse portion X2, stub 6*b* is arranged from transverse portion X2 to the input end of center conductor 4*b*. In this arrangement, when a distance between transverse portion X2 and the input end of center conductor 4*b* is represented by d2 and the length of stub 6*b* is represented by L2, L2<d2<λ/4 is satisfied.

In each of the high-frequency filters shown in FIGS. 12A to 12D, by satisfying λ/4<L1<d1, two attenuation poles P1, P3 are formed in the lower-frequency range than center frequency f0 in the band characteristic of the filter. Also, by satisfying L2<d2<λ/4, two attenuation poles P2, P4 are formed in the higher-frequency range than center frequency f0. In these high-frequency filters, as explained in the first embodiment, by forming stubs from respective transverse portions to both the input end side and the output end side of the center conductor, additional attenuation poles can be formed. An attenuation pole can be formed at any frequency point by adequately setting the position of transverse portion X and the length of each stub 6.

In the cascade-connected first and second coplanar line resonators, it is possible to make the attenuation gradient in the band characteristic in the high-frequency filter steeper by coincidence of these resonance frequencies. Additionally, it is possible to made the passband as the high-frequency filter wider by making the resonance frequencies of the respective coplanar line resonators different.

In the above-mentioned explanations, two coplanar line resonators are cascaded-connected, however, three or more coplanar line resonators may be cascade-connected to form a multi-stage high-frequency filter.

In the first and second embodiments as explained above, the length of the center conductor is one-half wavelength relative to the resonance frequency, however, the length may be one wavelength. Principally, the length of the center conductor may be integral multiples of half wavelength so that the waveform of the standing wave is anti-symmetrical relative to the midpoint of the center conductor. Also, in the above explanations, attenuation poles are formed in the band characteristic of the filter, however, attenuation poles (i.e., parallel arm resonance points) may be formed in any transmission characteristic.

Figure 13A:
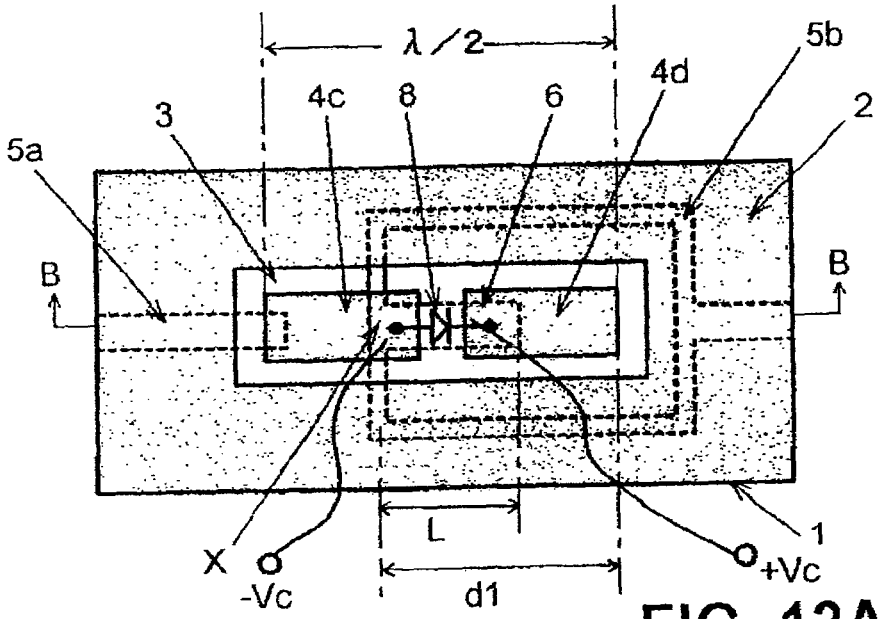
FIG. 13A is a plan view showing a high-frequency filter according to a third embodiment of the present invention.
Figure 13B:
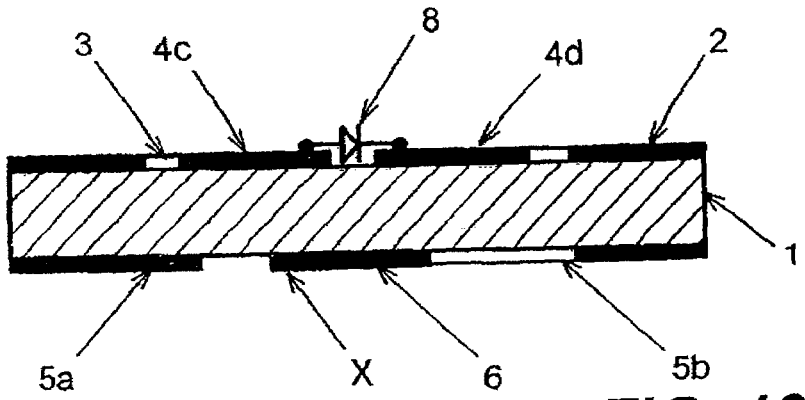
FIG. 13B is a cross-sectional view taken along line B-B in FIG. 13A.

Next, explanations are given of a high-frequency filter according to a third embodiment of the present invention. The high-frequency filter according to the third embodiment is one in which each of the above-mentioned high-frequency filters according to the first and second embodiments is changed into a variable-frequency type. In FIGS. 13A and 13B showing the high-frequency filter according to the third embodiment, the same reference numerals are applied to the same constituents as those in FIGS. 4A and 4B, and redundant explanations thereof are simplified.

The high-frequency filter shown in FIGS. 13A and 13B is one in which the high-frequency filter of the first embodiment shown in FIGS. 4A and 4B is changed into a variable-frequency type high-frequency filter. In the high-frequency filter shown in FIGS. 13A and 13B, center conductor 4 of the coplanar line resonator is divided at the midpoint in the longitudinal direction thereof. In center conductor 4*a*, a portion at the input end side from the midpoint is called first conductor 4*c*, and a portion at the output end side from the midpoint is called second conductor 4*d*. At the midpoint of divided center conductor 4, as a variable-reactance element of a voltage control type, voltage-variable capacitive element 8 such as a variable-capacitance diode is inserted. The cathode of voltage-variable capacitive element 8 is connected to first conductor 4*c*, and the anode is connected to second conductor 4*d*. Further, control voltage Vc is applied between the anode and the cathode such that relatively positive voltage is applied to the cathode while relatively negative voltage is applied to the anode. The configuration in which the center conductor of the coplanar line resonator is divided at the midpoint thereof and a variable reactance element is arranged at the division position is disclosed in US Patent Publication No. 2005/0162241A.

Input line 5*a* is formed in a linear line extending from the left end (as shown) of substrate 1 and is overlapped with the input end side of first conductor 4*c* through substrate 1 so as to be electromagnetically coupled. On the other hand, output line 5*b* includes a closed loop line portion surrounding the output end of the coplanar line resonator and an extension portion extending from the closed loop line portion to the right end (as shown) of substrate 1. The closed loop line portion of output line 5*b* is formed in an approximate rectangle and extends transversely across center conductor 4. A position where the closed loop line portion crosses center conductor 4 1 is defined as transverse portion X. On the other main surface of substrate 1, stub 6 is arranged so as to overlap with first and second conductors 4*c*, 4*d* from transverse portion X to the output end side of center conductor 4.

In the high-frequency filter like this, by controlling control voltage Vc to be applied to voltage-variable capacitive element 8, the capacitance of voltage-variable capacitive element 8 varies and the substantial electric length of center conductor 4 varies. Therefore, since the resonance frequency (i.e., center frequency) f0 of the coplanar line resonator varies, the high-frequency filter can be changed into the variable-frequency type by the control voltage. When center frequency f0 is varied by control voltage Vc, the minimum center frequency is represented by $f0_{min}$ and the maximum center frequency is represented by $f0_{max}$. A wavelength corresponding to frequency $f0_{min}$ is represented by $\lambda_{max}$ and a wavelength corresponding to frequency $f0_{max}$ is represented by $\lambda_{min}$. In this arrangement, when $d1>\lambda_{max}/4$ and $L<\lambda_{min}/4$ are satisfied where a distance from transverse portion X to the output end of second conductor 4*d* is represented by d1 and the length of stub 6 is represented by L, attenuation poles P1, P2 can be formed at both sides of center frequency f0 not dependently on the change of center frequency f0.

The midpoint of center conductor 4 is the minimum voltage displacement point, namely, the null point in the standing wave. Therefore, in the high-frequency filter shown in FIGS. 13A and 13B, though voltage-variable capacitance element 8 is arranged at the midpoint, resonance characteristics of the coplanar line resonator can be maintained satisfactorily.

Figure 14:
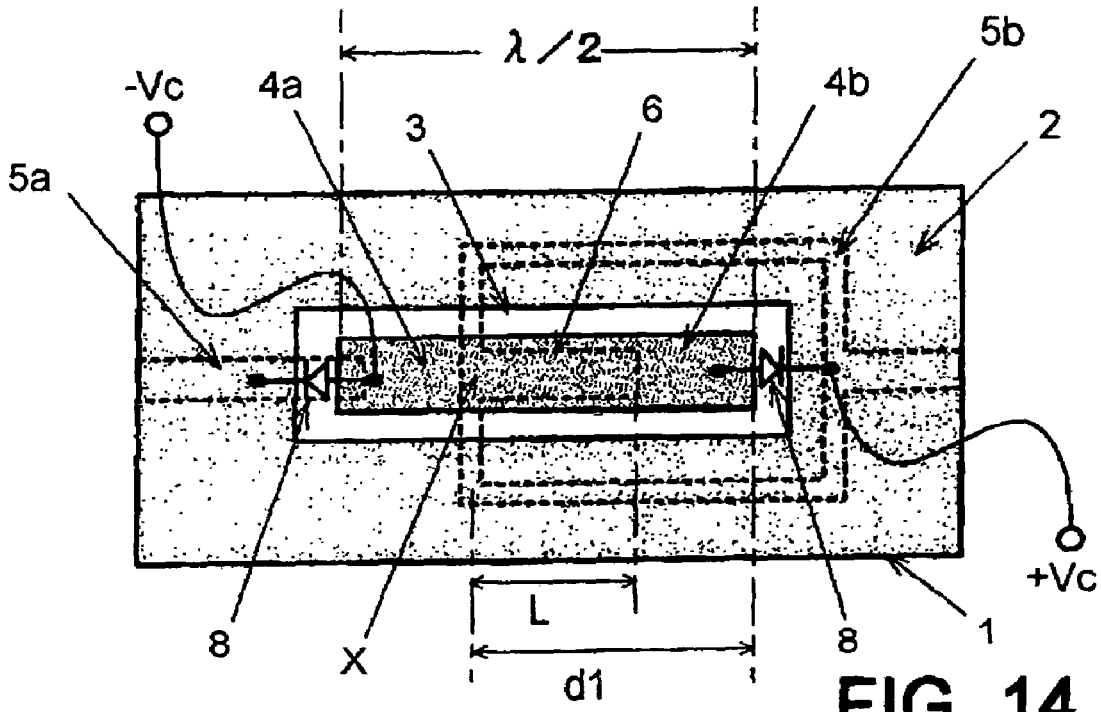
FIG. 14 is a plan view showing another example of the high-frequency filter according to the third embodiment.

A high-frequency filter shown in FIG. 14 is one in which voltage variable-capacitance elements 8 are arranged at both the input end and the output end of center conductor 4 in the high-frequency filter shown in FIGS. 4A and 4B. In other words, a first voltage-variable capacitance element 8 having an anode connected to center conductor 4 and a cathode connected to ground conductor 2 is arranged at the position of the input end of center conductor 4, and a second voltage-variable capacitance element 8 having an anode connected to center conductor 4 and a cathode connected to ground conductor 2 is arranged at the position of the output end of center conductor 4. By impressing control voltage Vc between center conductor 4 and ground conductor 2 such that center conductor is relatively negative while ground conductor 2 is relatively positive, control voltage Vc is applied to these voltage-variable capacitance elements 8. Incidentally, U.S. Pat. No. 6,798,319 discloses that voltage-variable capacitance elements 8 are respectively arranged at the input end and the output end of center conductor 4 in the coplanar line resonator.

In the high-frequency filter shown in FIG. 14, each capacitance value of each voltage-variable capacitance elements 8 varies in accordance with control voltage Vc and the substantial electric length of center conductor 4 varies. Therefore, since the resonance frequency (i.e., center frequency) f0 of the coplanar line resonator varies, the high-frequency filter can be changed into the variable-frequency type. However, in this configuration, since voltage-variable capacitance elements 8 are arranged at both ends of center conductor 4 which are to be maximum voltage displacement points, the resonance characteristic of the coplanar line resonator tends to vary. In view of this point, voltage-variable capacitance element 8 is preferably arranged at the midpoint of center conductor 4 as shown in FIGS. 13A and 13B.

In the above-mentioned third embodiment, the high-frequency filter according to the first embodiment is changed into the variable-frequency type, however, in the high-frequency filter according to the second embodiment, a voltage-variable capacitance element may be connected to at least one coplanar line resonator so that the high-frequency filter is changed into the variable-frequency type.

What is claimed is:

1. A high-frequency filter comprising:

a substrate;

a ground conductor disposed on one main surface of the substrate and having an opening;

a center conductor disposed on one main surface of the substrate in the opening and making up a coplanar line resonator of a coplanar structure together with the substrate and the ground conductor;

an input line of a microstrip line structure, disposed on the other main surface of the substrate and electromagnetically coupling with one end of the center conductor; and an output line of a microstrip line structure, disposed on the other main surface of the substrate and electromagnetically coupling with the other end of the center conductor:

wherein at least one of the input line and the output line has a closed loop line portion surrounding a corresponding end of the center conductor and crossing the center conductor transversely through the substrate; and wherein on the other main surface of the substrate, a stub overlapping with the center conductor is arranged from a transverse portion where the closed loop line portion crosses the center conductor;

wherein the closed loop line portion forms a first attenuation pole in a band characteristic of the coplanar line resonator and the stub forms a second attenuation pole in the band characteristic, wherein the first attenuation pole and the second attenuation pole are positioned at both sides around a center frequency of the band characteristic of the coplanar line resonator.

2. The high-frequency filter according to claim 1, wherein the first attenuation pole is formed at a frequency point based on an electric length corresponding to a distance from the transverse portion to an end corresponding to the closed loop line portion in the center conductor and the second attenuation pole is formed at a frequency point based on an electric length of the stub.

3. The high-frequency filter according to claim 2, wherein the electric length corresponding to the distance is one-quarter wavelength corresponding to a frequency of the first attenuation pole, and the electric length of the stub is one-quarter wavelength corresponding to a frequency of the second attenuation pole.

4. The high-frequency filter according to claim 1, further comprising a reactance element of a voltage control type making an electric length of the center conductor variable in the coplanar line resonator.

5. The high-frequency filter according to claim 4, wherein the center conductor is divided at a midpoint thereof and the reactance element is inserted into the midpoint.

6. The high-frequency filter according to claim 1, wherein the stub is formed from the transverse portion to one end of the center conductor.

7. The high-frequency filter according to claim 1, wherein the stub is formed from the transverse portion to each of both ends of the center conductor.

8. A multi-stage high-frequency filter comprising a plurality of high-frequency filters according to claim 1, wherein the plurality of high-frequency filters are cascade-connected while sharing one substrate.

9. A multi-stage high-frequency filter comprising a plurality of high-frequency filters according to claim 1, wherein the plurality of high-frequency filters are cascade-connected while sharing one substrate, in at least a pair of adjacent high-frequency filters, as an output line of a first high-frequency filter and as an input line of a second high-frequency filter, a closed loop line surrounding an output end of the first high-frequency filter and an input end of the second high-frequency filter is arranged.

* * * * *